US006698357B2

(12) United States Patent
Jones

(10) Patent No.: US 6,698,357 B2
(45) Date of Patent: Mar. 2, 2004

(54) HYDROCARBON WARHEAD AND METHOD

(75) Inventor: John W. Jones, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/825,940

(22) Filed: Apr. 5, 2001

(65) Prior Publication Data

US 2004/0016355 A1 Jan. 29, 2004

(51) Int. Cl.[7] ..... F42B 12/16

(52) U.S. Cl. ..... 102/363; 102/364; 102/367; 102/365; 89/1.11

(58) Field of Search ..... 89/1.11; 102/363, 102/364, 367, 365

(56) References Cited

U.S. PATENT DOCUMENTS

| | | | | | |
|---|---|---|---|---|---|
| 2,489,610 | A | | 11/1949 | Barker | 102/6 |
| 3,496,867 | A | | 2/1970 | MacDonald | 102/6 |
| 3,685,453 | A | | 8/1972 | Hamrick | 102/90 |
| 3,786,756 | A | * | 1/1974 | Looger | 102/363 |
| 3,955,509 | A | * | 5/1976 | Carlson | 102/363 |
| 3,994,226 | A | * | 11/1976 | Rakowsky et al. | 102/363 |
| 4,132,170 | A | * | 1/1979 | Hardy et al. | 102/363 |
| 4,141,294 | A | * | 2/1979 | Zaharia | 102/363 |
| 4,157,928 | A | * | 6/1979 | Falterman et al. | 102/363 X |
| 4,273,048 | A | * | 6/1981 | Aley et al. | 102/363 |
| 4,463,680 | A | | 8/1984 | Sayles | 102/363 |
| 4,967,666 | A | | 11/1990 | Kellner et al. | 102/476 |
| 5,160,803 | A | | 11/1992 | Fulchiron et al. | 102/363 |
| 5,168,123 | A | | 12/1992 | Lee | 102/363 |
| 5,303,653 | A | | 4/1994 | Sullivan et al. | 102/363 |
| 5,526,752 | A | | 6/1996 | Dahl et al. | 102/517 |
| 5,829,032 | A | | 10/1998 | Komuro et al. | 711/141 |
| 6,105,505 | A | | 8/2000 | Jones | 102/364 |

* cited by examiner

*Primary Examiner*—Michael J. Carone
*Assistant Examiner*—John Richardson
(74) *Attorney, Agent, or Firm*—Burns, Doane, Swecker and Mathis, LLP

(57) ABSTRACT

A gas-phase warhead for use against a hardened and deeply buried target containing a payload that is ignitable when combined with air. After the warhead is delivered near an air intake of a target, the payload is expelled from the casing of the warhead in a slow, controlled manner so as to allow the formed payload-and-air mixture to infiltrate the areas of the target. After a predetermined amount of time, the payload-and-air mixture is ignited and a detonation or a deflagration within the target occurs.

16 Claims, 5 Drawing Sheets

FIG. 2
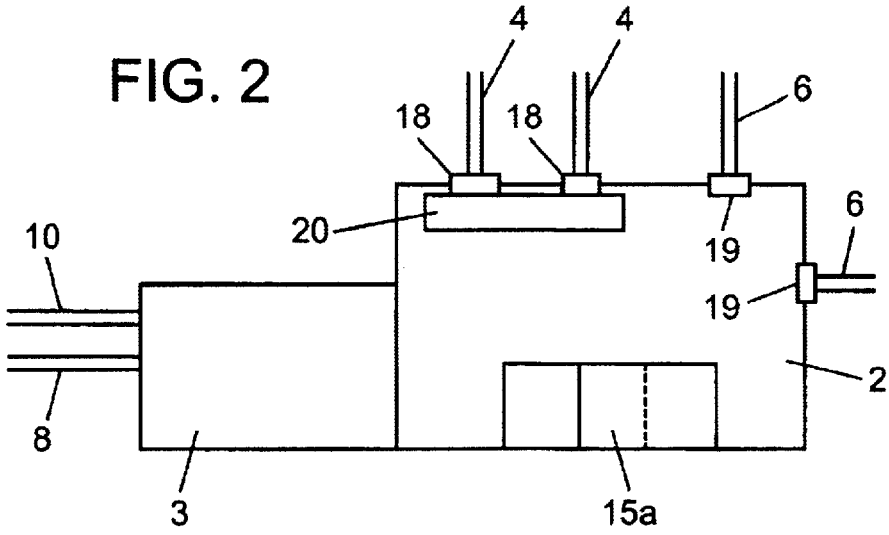
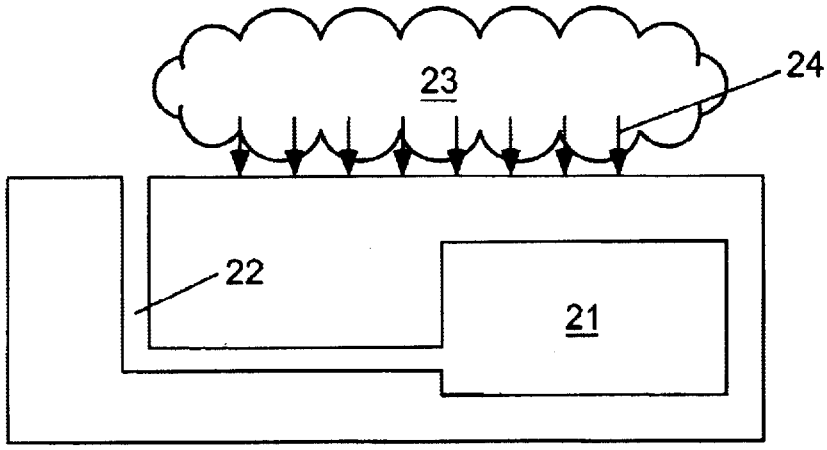
FIG. 3a
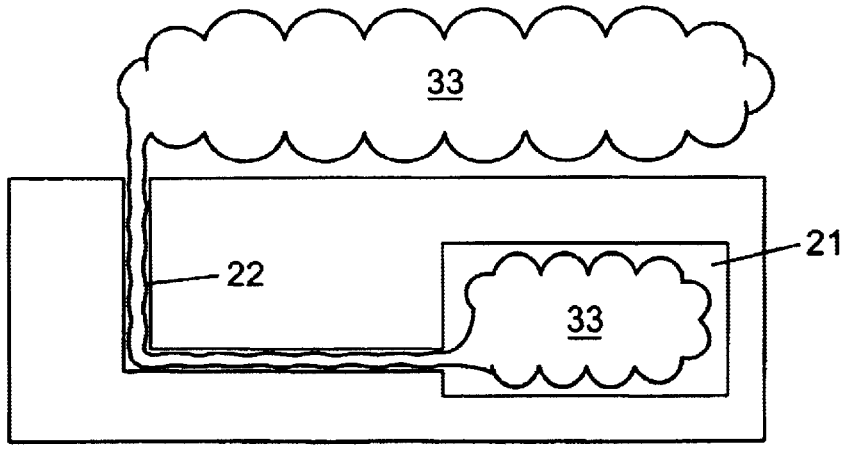
FIG. 3b

HYDROCARBON WARHEAD AND METHOD

FIELD OF THE INVENTION

The present invention relates generally to penetrating and impact weapons and more particularly to the use of a hydrocarbon warhead to defeat a surface target and/or a hardened and deeply buried target.

BACKGROUND OF THE INVENTION

As research and technology continuously produce weapons more sophisticated, deadly, and accurate than their predecessors, the need for effective defensive mechanisms and strategies to be employed against such weapons obviously increases. During a conflict, one main objective of these defenses is to protect vital military facilities, the destruction of which would leave a nation or region vulnerable to aggressors. In the modern era of long-range weapons of mass destruction, one intuitively simple defensive strategy that has so far proved successful in withstanding weapons advances is the positioning of military facilities underground. While conventional kinetic warheads are capable of causing major near-surface damage, most of these weapons are relatively useless against a target buried and fortified deep within the earth. Such a target is typically referred to as a hardened and deeply buried target or HDBT. Some weapons have been developed to destroy shallow underground targets, but the penetration of these weapons is typically limited to no more than about 30 feet of reinforced concrete or rock, whereas a HDBT may be located hundreds of feet below the surface. In most instances, even shockwaves propagated from surface explosions have little effect on a HDBT.

Because control and command centers, as well as facilities for weapons development, manufacture, storage, and deployment, are increasingly being housed in such underground structures, weapons and strategies must be developed to defeat them in order to efficiently end a conflict. To date, only nuclear warheads have the power to disable HDBT's, but the use of such weapons has been generally deemed as impractical, given the far-reaching destructive effects of a nuclear explosion, including massive "collateral damage", and the limited area of most regional conflicts.

Additionally there are needs for weapons that may be used to attack lightly hardened targets and buildings that may be free standing, buried, semi-buried or lightly hardened and buried at shallow depth. Attack of such targets with conventional high explosive weapons carries with it the danger of unacceptable collateral damage to nearby structures such as schools, residences, or hospitals.

The ability to defeat both soft industrial and HDBT's is becoming increasingly important for the success of military operations. Accordingly, there is a need for an efficient and practical method of accomplishing this task with weapons of low collateral damage potential.

SUMMARY OF THE INVENTION

The present invention is directed to a hydrocarbon gas-phase warhead that can be used to attack soft, and hardened and deeply buried targets.

According to one aspect of the present invention, a method is provided for defeating a hard and deeply buried target, wherein the target comprises a plurality of air vents that lead to the buried target, comprising the steps of positioning a warhead in, or near, at least one of the plurality of air vents, expelling a payload from the warhead into the at least one of the plurality of air vents, therein creating a combustible mixture of expelled payload and air inside the target, delaying ignition of the mixture for a predetermined amount of time, and then igniting the mixture to produce an explosion inside the target.

According to a second aspect of the present invention, a warhead is provided for defeating a soft, or hard and deeply buried target, comprising a casing, a payload contained within the casing, and an igniter, whereby the payload is expelled from the casing at a predetermined rate, creating a mixture of expelled payload and air, and the mixture is ignited or detonated by the igniter after a predetermined amount of time.

According to another aspect of the present invention, a warhead is provided for defeating a hard and deeply buried target, comprising a casing, a payload contained within the casing, a means for expelling the payload contained within the casing to the surrounding area thereby creating an explosive payload and air mixture, and an igniter adapted to ignite or detonate the explosive mixture.

According to yet a further aspect, the present invention provides a method of defeating a soft target having an exterior and an interior, the method comprising: penetrating the exterior of the target with a penetrating warhead with a trajectory suitable to locate the warhead within the interior of the target; releasing a payload material contained within the warhead thereby forming a payload-air mixture within the interior of the building; and igniting the payload-air mixture after a predetermined amount of time.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein:

FIG. 2 illustrates a more detailed view of the target;

FIG. 3*a* illustrates an unconfined detonation of a fuel air mixture;

FIG. 3*b* illustrates a confined detonation of a fuel air mixture;

DETAILED DESCRIPTION OF THE INVENTION

Figure 1:
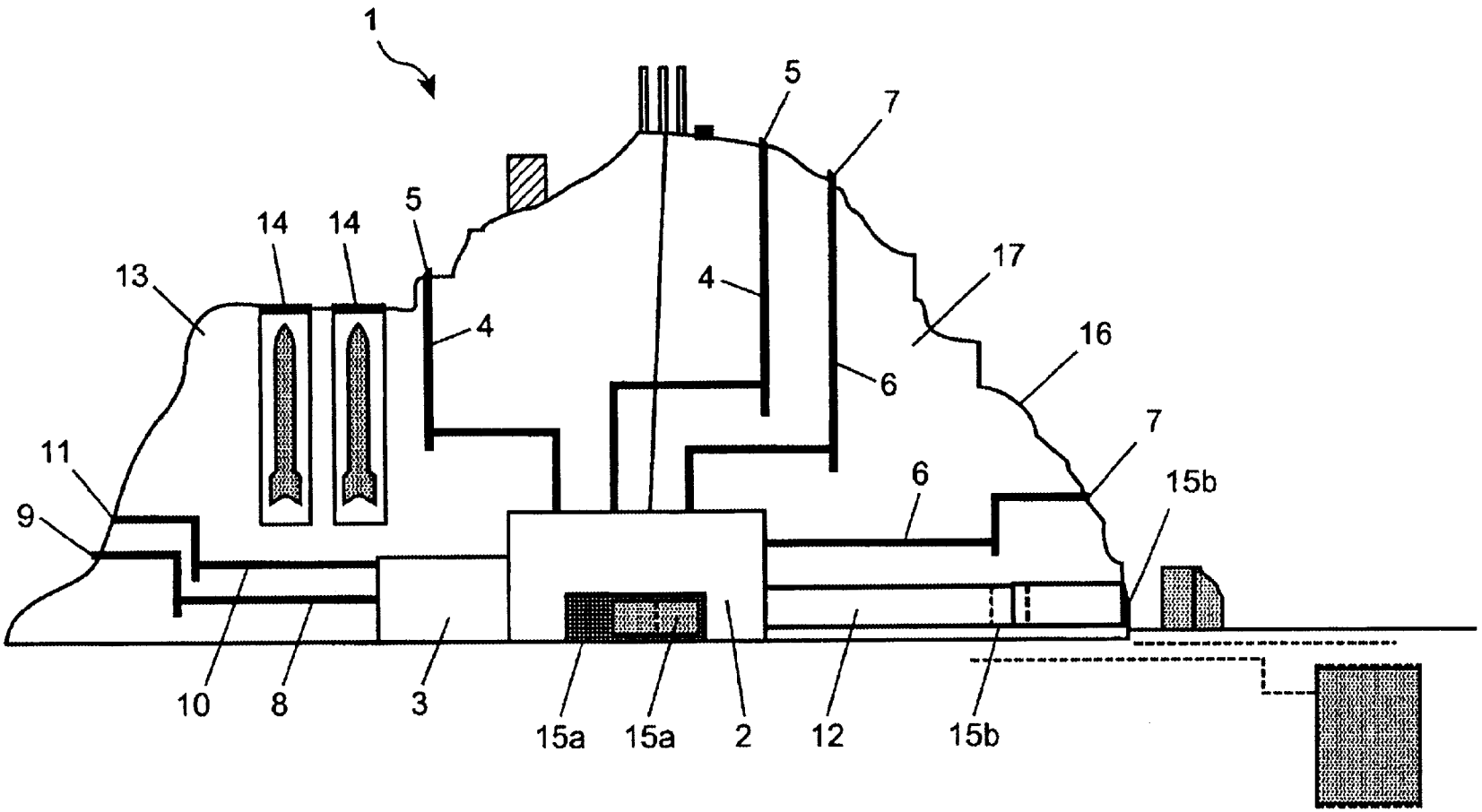
FIG. 1 schematically illustrates a generic hard and deeply buried target.

To begin, it is helpful to consider the elements of an HDBT, which is one of the types of structures targeted by the present invention. Because HDBT's may vary significantly in size, geometry, and purpose, the target 1 shown in FIG. 1 represents only a generic composite of modern-day HDBT's, comprising some of the common elements often associated with such structures. All dimensions relating to the elements of target 1 are approximate and for purposes of illustration only.

As shown in the figures, the elements of target 1 are located at or below surface 16 or within formation 17, which may be made of rock (e.g., granite or limestone) or soil, in which case the target 1 may be underground. Underground facility 2, where the HDBT command center and most of the personnel is located, can be positioned well below the surface 16 and reinforced, for example, with concrete overburdens. To the present day, such a configuration is often an effective defense against physical attacks from conventional kinetic weapons, as such weapons and their effects cannot penetrate far enough into the ground or the hardened protection to damage the underground facility 2.

In order to provide breathing air to the personnel stationed in the underground facility 2, input vents 4 extend from underground facility 2 through formation 17 to the surface 16, where air intakes 5 are positioned to intake outside air. Exhaust vents 6 also extend from underground facility 2 through formation 17 to the surface 16, where air exhausts 7 expel air from inside the underground facility 2 to create air circulation between facility 2 and the outside environment. As shown in FIG. 2, blast valves 18 and 19 are located within underground facility 2 and respectively attached to input vents 4 and 6. These valves operate to attenuate shock waves (e.g., from incident pressure of 8 atm to an reduced pressure of 0.2 or 0.4 atm) and will automatically shut within a fraction of a second upon detection of a strong airborne shockwave. Also shown in FIG. 2 is an air handling unit 20, which is attached to blast valves 18. The air handling unit 20 distributes air to different areas of target 1 through interior ventilation ducts and comprises filters, fans, and cooling means. The filters used in air handling 20 may be manufactured to high efficiency particulate arrestance (HEPA) specifications.

FIGS. 1 and 2 also show auxiliary room 3, which houses auxiliary generators (e.g., diesel power) and optional air handling equipment (not shown). The auxiliary room 3 is also reinforced and positioned deep beneath surface 16, close to or directly adjacent to the underground facility 7. When the auxiliary generator is running, air intake 9 and input vent 8 work to draw outside air into auxiliary room 3 for its operation, while exhaust vent 10 and air exhaust 11 expel the used air.

Target 1 also comprises missile silos 13, shown in FIG. 1, which house and deploy warheads. The destruction of such warheads is usually a prime objective during a military operation, but difficult to accomplish, as the missile silos 13 are protected with steel doors 14 and, like underground facility 2 and auxiliary room 3, located deep underground.

As shown in FIG. 1, tunnel 12 extends from underground facility 2 and provides a passageway for personnel to walk through. The tunnel 12 may lead to the outside of the HDBT, as shown in the figure, or to another underground facility. The main entrance tunnel to the underground may also be used as a route of ingress or egress of ventilation air.

Protection for the tunnel and its occupants is provided by a series of blast doors 15*b*. The blast doors are normally open except when an attack is anticipated or in progress. Although FIG. 1 only shows one tunnel, an HDBT may comprise many tunnels of varying geometry and configuration. Also, entry to and from underground 2 in another direction is provided by blast doors 15*a*.

Volumes corresponding to some of the major elements of FIGS. 1 and 2 are shown in Table 1 below. As mentioned above, these values are presented for purposes of illustration.

TABLE 1

Exemplary Volumes of Target Elements and Entire Target

| Target Element(s) from FIG. 1 | Volume ($m^3$) |
|---|---|
| Vents (elements 4, 6, 8, and 10) | 235 |
| Auxiliary Room (element 3) | 150 |
| Tunnel (element 12) | 960 |
| Underground Facility (element 2) | 8,000 |
| Missile Silos (element 13) | 1,965 |
| Total | 13,272 (or 469,623 $ft^3$) |

An objective of the present invention is to defeat such a target as the one illustrated in FIGS. 1 and 2. The defeat of an HDBT can be accomplished by the physical destruction of its military capabilities and/or the killing of its human personnel, in all cases rendering the structure and its facilities useless for conflict purposes. As described above, an HDBT such as target 1 requires the intake of outside air either for human respiration or power generation. This need creates a weakness in an HDBT that can be exploited during a conflict. By infiltrating the air handling system of an HDBT with a low molecular weight hydrocarbon, preferably in a gaseous state, that is flammable or explosive when mixed with air, an exemplary embodiment of the present invention aims to defeat the target without using pure kinetic or physical force (i.e., as with conventional penetrating weapons).

One objective of the present invention is to create a confined explosion inside an HDBT, as opposed to an unconfined explosion in close proximity with an HDBT, using a fuel-air mixture. Some existing fuel-air explosive (FAE) weapons are capable of creating unconfined fuel-air explosions, one of which is illustrated in FIG. 3*a*. As shown in the FIG. 3*a*, a fuel-air mixture 23 is formed above target 21, which is located underground and receives outside air through vent 22. Typically, the fuel-air mixture 23 is formed by the explosive dispersion of liquified gas from a weapon into the air, the gas being dispersed by, for example, the detonation of an explosive within the weapon. This fuel-air mixture 23 is ignited within a short time (e.g., a fraction of a second) after its formation and results in an inert shock transmission 24 that may effect the surface above target 21, but not target 21 itself. Only a limited variety of payload materials can be used for unconfined fuel-air explosions, and such explosions are effective only when gas phase detonations are achieved.

In contrast, FIG. 3*b* illustrates a confined fuel-air explosion, which an exemplary embodiment of the present invention attempts to create within an HDBT. In this case, a fuel-air mixture 33 is initially formed at the surface above target 21. However, through controlled dispersion of a weapon's payload and the operation of the air intake, the fuel-air mixture 33 is delivered through vent 22 and into the confined areas of target 21. When the amount of fuel-air mixture 33 in target 21 is adequate for a destructive explosion or deflagration, the fuel-air mixture 33 is ignited. Unlike the unconfined fuel-air explosion in free air of FIG. 3*a*, which occurs within a short time after release, the confined fuel-air explosion of FIG. 3*b* must be delayed by at least several minutes to allow the fuel-air mixture 33 to infiltrate target 21. For unconfined fuel-air explosions, an ignition delay of this duration may completely undermine the mission of the weapon, as the fuel-air mixture in open air would quickly become diluted and surpass its explosive limits (i.e., volume at which a detonation may still occur).

Also, many payload materials and mixtures may be used for a confined fuel-air explosion, for the reason that the geometry of the confining structure will limit the expansion of a fuel-air mixture that enters it. In addition, the effects of igniting a confined fuel-air mixture may result in either a detonation or a deflagration, unlike an unconfined fuel-air explosion, which is only effective as a detonation.

A weapon for defeating an HDBT based on the concept of a confined fuel-air explosion as described above is illustrated in FIG. 4. Casing 41 may be from a conventional or penetrating bomb (such as a modified BLU-109/B, JAST-1000, JASSM-1000, BLU-116, or an MK-80 series weapon) or may be any design that can be hard- or soft-landed and strong enough to survive impact with the intended target. Filler cap 42 is used to fill casing 41 with payload 43, which is preferably a liquified material, preferably a liquified hydrocarbon, which will expand into a gaseous state upon release and either deflagrate or detonate when mixed with air and ignited. Assumptions of this example of the present invention are based on a generic 2,000-lb bomb payload.

Examples of possible payloads include, but are not limited to, hydrocarbons such as nature gas, methane, propane, butane, ethylene, benzene, cyclohexane, and ethylene oxide. Most of the preferred gas candidates are common and commercially available in large quantity. Also, storage of such payloads should not be any more hazardous than for a backyard gas barbeque. A mixture of hydrocarbons may be used, but a primary requirement is that the gas or gas mixture must be flammable and have a gas density near or greater than the density of atmospheric air.

TABLE 2

Exemplary Payloads for Warhead

| Gas | Density Relative to Air @ STP | Weight as liquid (lb) | Explosive Limits (%) in air |
|---|---|---|---|
| $CH_4$ (methane) | 0.55 | 122 | 5–15 |
| $C_2H_6$ (ethane) | 1.05 | 168 | 3–12.5 |
| $C_3H_8$ compound | 1.5 | 235 | 2.1–9.5 |
| Ethylene oxide | 1.52 | 369 | 3–100 |

Table 2 above shows some characteristics for exemplary payloads which may be used in the present invention. The given explosive limits of each material is the percent by volume of payload in air that, if ignited, is explosive. Methane and ethane make explosive mixtures with air only over concentration ranges around 4–14%, while ethylene oxide is explosive over a percentage range in air of 3–100%.

Depending on the type of liquified gas contained within casing 41, the opening of venturi vents 46 alone may result in the release and self-gasification of payload 43. However, some payloads may require the activation of gas generator 44, which will inflate expulsion bladder 45 to displace payload 43 out of casing 41 through venturi vents 46. Igniter 47 is actuated to ignite the resultant fuel-air mixture after a predetermined delay time, preferably after the resultant fuel-air mixture has had time to infiltrate the target.

Figure 4:
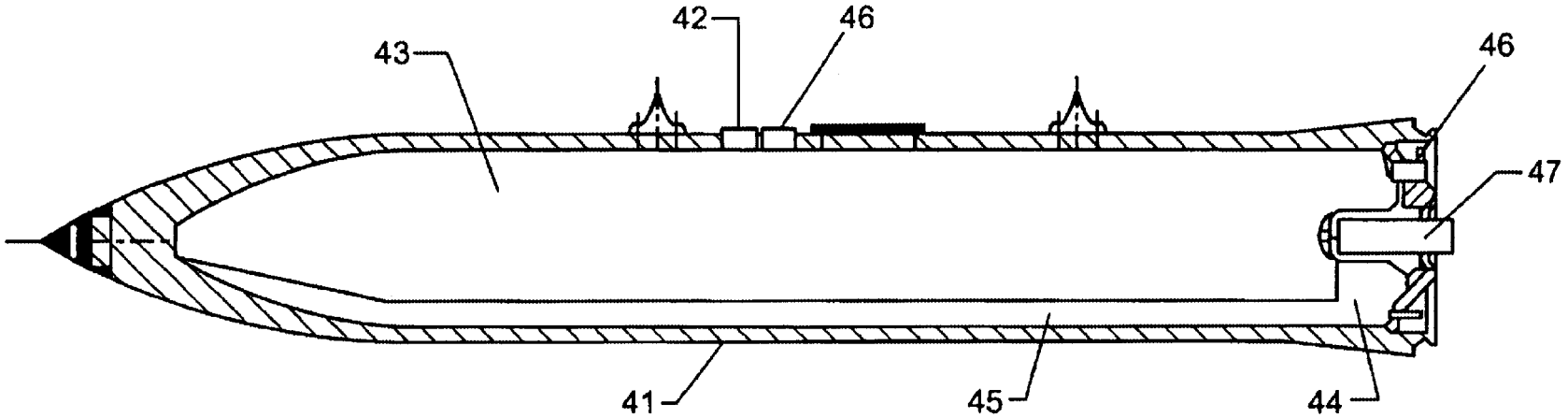
FIG. 4 illustrates a warhead in accordance with an embodiment of the present invention.
Figure 5:
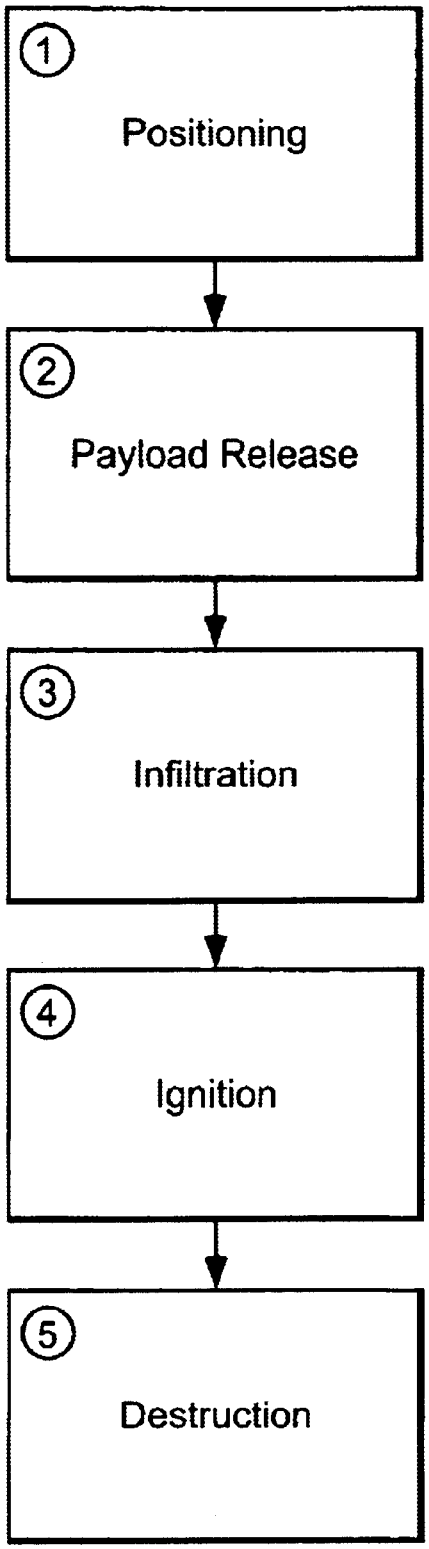
FIG. 5 illustrates the operation of the warhead in accordance with an embodiment of the present invention.

The flowchart of FIG. 5 illustrates the operation of an embodiment of the present invention. In the following discussion of FIGS. 1 and 2 and the warhead of FIG. 4 are referenced for purposes of illustration. However, the operation/method and its associated principles are also applicable in the context of other targets, such as a "soft target," and other apparatus utilized to carry out the method.

At Step 1, the warhead is positioned on, in, or near one of air intakes 5 and 9, which draw outside air into input vents 4 and 8, respectively. At least one or more warheads will be delivered to each air intake of target 1. A warhead may reach target 1 one of several ways, including being hard-landed (e.g., dropped from an airplane and optionally guided and/or propelled to the target) or soft-landed (e.g., by parachute).

Step 2 involves the releasing of payload 43 from casing 41 of the warhead. As briefly discussed before, payload 43 is preferably a liquified gas that pass into the target past the blast valves, and filters and is ignitable when mixed with air. Depending on the type of material used as payload 43, and the vapor pressure inside the warhead, opening of venturi vents 46 alone (which may be actuated, for example, by a solenoid timer) may result in the release and dispersion of payload 43 into the air outside the warhead. At room temperature, for example, liquid propane is self-gasifying. Alternatively, if payload 43 is not self-gasifying at the ambient temperature, gas generator 44 and expulsion bladder 45 are used to force payload 43 out through venturi vents 46. In either case, payload 43 is vaporized upon release and mixes with outside air to form a fuel-air cloud that is ignitable. If the warhead is hard-landed, initiation of gas release should preferably be delayed for some period of time (e.g., several minutes), as casing 41 may temporarily be hot enough ignite the fuel-air cloud prematurely (i.e., before infiltration of target 1).

Step 3 is the infiltration step, where the fuel-air mixture created by the release of payload 43 is allowed time to infiltrate target 41. Payload gases 43 expanding from the warhead are typically cold in Step 2 and will tend to result in a "ground hugging" gas cloud, which will persist for several minutes, even in mild winds. In an exemplary embodiment of the present invention, this release is near or in an air intake (resulting from Step 1) and in a controlled and metered manner, unlike the split-second dispersion of payload gas in a conventional FAE. By releasing payload 43 in such a way, the resultant fuel-air cloud will be "sucked" into one of vents 4 by one of air intakes 5. The amount of flammable gas entering target 41 will be designed such that infiltration of critical parts of the target will occur before ignition of the gas. The amount of gas payload required will depend on the size and construction of the target and may range from a few pounds to a few hundred pounds. Preferably, the infiltration step will result in 100–200 lbs. of fuel-air mixture entering any given air intake and vent in attack of a target of the size of the one illustrated in FIGS. 1 and 2.

In order to allow the fuel-air mixture time to enter air intakes 5 and 9, travel through vents 4 and 8, and infiltrate underground facility 2 and auxiliary room 3, the release of payload 43 may take more than one minute, up until the moment of ignition. The exact duration of Step 3 will depend on several factors, such as the type of gas used and the layout of the target in question. For example, if auxiliary power is running, the fuel-air mixture will arrive inside auxiliary room 3 in a fraction of a minute, given the high air demand of the diesel generator inside the room. Tables 3 and 4 below illustrate exemplary optimal duration of fuel-air mixture flow for two different attack scenarios. Both scenarios are based upon the target element volumes from Table 1 and several air demand assumptions at sea level STP (all for example purposes). First, that the personnel staff consists of 100 mildly stressed humans who need approximately 250 $ft^3$ of air per minute (using conventional mine practice). Second, that the air velocity in the vents is approximately 17 ft/min, assuming two vents are intakes and two are exhausts, and that air velocity in the vents is approximately 17 ft/min, assuming two vents are intakes and two are exhausts. Third, that one weapon is delivered per vent, that 50% of the weapons are delivered in or on an air intake, and that the ambient atmosphere is stagnant. For Table 3, it is also assumed that the hydrocarbon is delivered from the weapon into one air intake at 100% efficiency at a flow rate near the midpoint of the explosive range. For Table 4, the efficiency is at 25%.

TABLE 3

| Target Attack Scenario I (100% efficiency) | | |
|---|---|---|
| Gas | Flow Rate (lb/min) | Duration of Flow (min) |
| $C_2H_2$ | 3.75 | 49 |
| $CH_4$ | .75 | 163 |
| $C_2H_6$ | .75 | 224 |

From Table 3, it can be seen that delivering hydrocarbon into an air intake under the assumed conditions can create an explosive atmosphere inside underground facility 2 which will last about one to four hours.

TABLE 4

| Target Attack Scenario II (25% efficiency) | | |
|---|---|---|
| Gas | Flow Rate (lb/min) | Duration of Flow (min) |
| $C_2H_2$ | 15 | 12.3 |
| $CH_4$ | 3 | 40.8 |
| $C_2H_6$ | 3 | 56 |

In the attack scenario of Table 4, the fuel-air mixture would infiltrate underground facility 2 in about a quarter of an hour, under the assumed conditions.

At Step 3, igniter 7 is activated. Igniter 7 is preferably located externally and timer-controlled to activate after a predetermined amount of time corresponding to Step 3. Igniter 7 is preferably a sparking detonating explosive or a strong igniter such as the BKN03—Magnesium Teflon igniters well known in the munitions trade.

Once the fuel-air mixture is ignited, either a detonation or deflagration of the fuel-air mixture will occur at Step 4. The destructive effects of either case will depend upon the time at which the igniter is activated after the initial release of payload 3. A minute after the initial release of payload (at 2–10 lbs/min) from a warhead placed near or on one of vents 5, the fuel-air mixture will have traveled down through vents 4, past the blast valves 18, and into air handling unit 20. If ignition occurs at this time, there will be a flame propagation (subsonic or supersonic) down one of vents 4 and an 8–18 bar (1 bar=14.7 psi at STP) explosion in air handling unit 20, the destruction of which constitutes a functional kill of target 1. Blast valves 18 are, as mentioned above, designed to attenuate shock waves. Because of this, the likelihood of a flame front transitioning into a detonation as it passes into the bunker is increased, as the valves are designed to create turbulent flow and leak flame jets.

If ignition occurs between a minute and up to half an hour after the initial release of payload, a detonation will be propagated into the interior of underground facility 2 and the personnel there will be neutralized. It can be assumed that anyone who was alive after the blast would suffocate because of depletion of oxygen in the air caused by the gas combustion. Depending on the explosive gas concentration achieved, blast pressures in the range of 100–300 psi can be anticipated in Step 4. Table 5 illustrates typical critical pressures for structural damage.

TABLE 5

| Interior Blast Damage | |
|---|---|
| Overpressure (psi) | Typical Structural Damage |
| 1 | Window glass shatters |
| 3 | Residential structures collapse |
| 5 | Most buildings collapse |
| 10 | Reinforced concrete buildings severely damaged or demolished |
| 20 | Heavily built concrete buildings are severely damages or demolished |
| 30 | Failure of concave blast doors |

As shown in Table 5, a weapon according to an embodiment of the present invention is capable of severely damaging an HDBT without using pure kinetic force. Such a weapon could also be used to destroy road and railroad tunnels in a similar fashion. Given the need for breathing and energy-producing air, countermeasures for such attacks would be difficult for many targets to implement.

Figure 6:
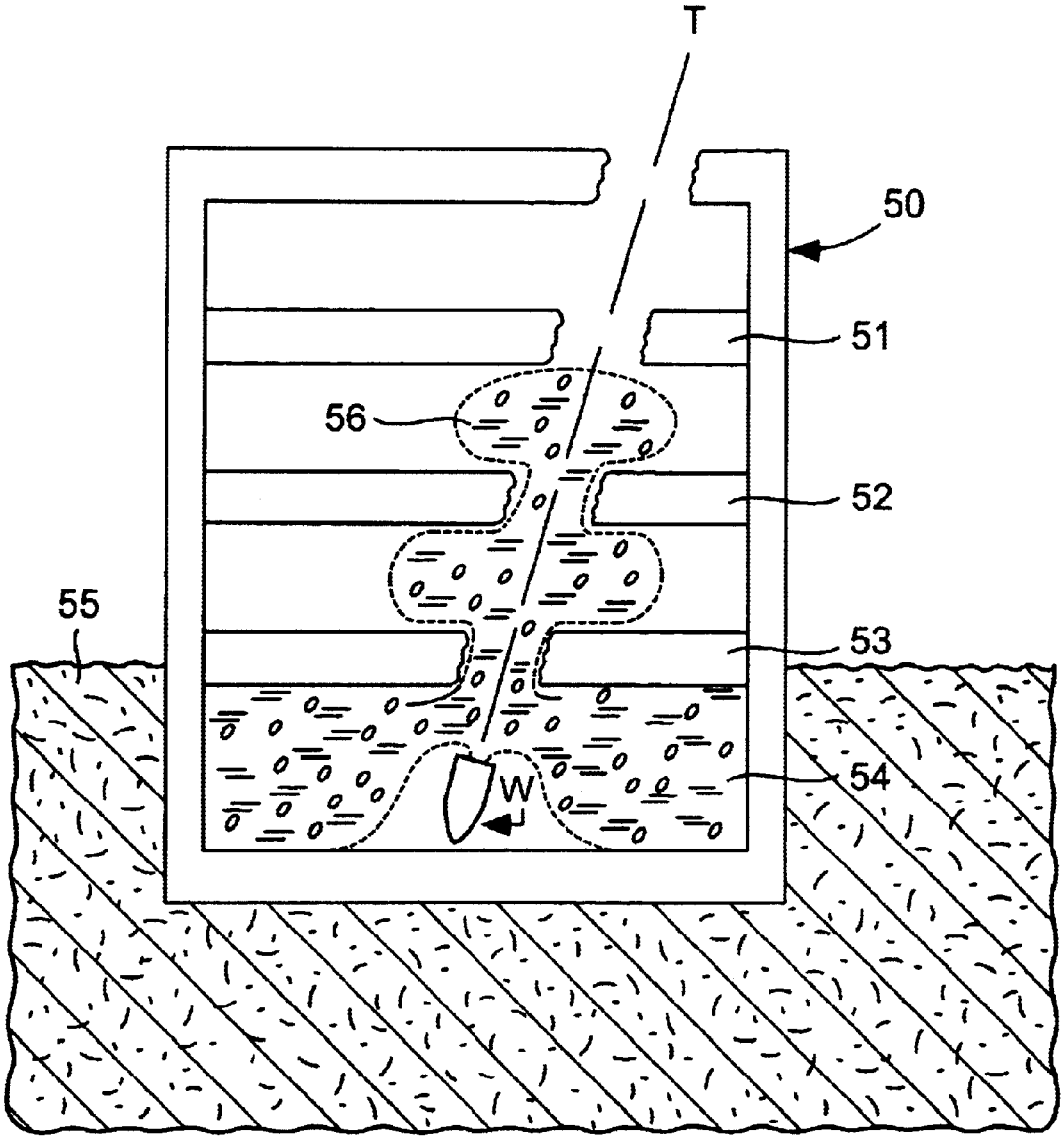
FIG. 6 is a schematic sectional illustration of another embodiment of the present invention.

Another embodiment of the present invention is generally illustrated in FIG 6. In this embodiment the principles of the present invention are applied in the context of attacking a "soft target". The term "soft target" is intended to comprehend free-standing buildings and structures, semi-buried buildings and structures, buildings and structures buried at a shallow depth, and/or lightly hardened or fortified buildings or structures. As previously noted, attack of such targets with blasts generated with conventional high explosive weapons often causes undesirable collateral damage to nearby structures.

As with the previously disclosed embodiments, the attack of such targets involves the modification of a suitable warhead to carry an appropriate, preferably liquid payload, releasing the payload subsequent to impact such that an appropriate mixture is formed with the surrounding air thereby forming an explosive cloud, and igniting the explosive cloud resulting in deflagration and/or detonation, and destruction or neutralization of the target while minimizing unwanted collateral damage.

A suitable warhead W can comprises a modification of an existing warhead, as previously discussed in connection with the previous embodiments and in connection with FIG. 4. Examples of existing weapons that could be modified for use in the attack of soft targets according to the principles of the present invention include (referenced by their standard designations): MK 84; MK 83; BLU-109/A or B; BLU-113; JASSM-1000; J-1000; Unitary 1K; BLU-116/A or B; AUP; and CALCM.

The warhead W carries a suitable payload material. Preferably, the payload comprises a liquified hydrocarbon that can form an appropriate explosive mixture when evaporated in air. A large number of hydrocarbons and mixtures are possible. This is especially true when, according to this embodiment, the warhead W is preferably introduced into the target thereby confining the hydrocarbon-air cloud within the structure, which further facilitates the formation of an explosive cloud or mixture. Reference is made to the previously disclosed payload materials as illustrative examples of such materials suitable for use in this embodiment.

Referring to FIG. 6, the warhead W is preferably introduced along a suitable trajectory T into the confines of the soft target 50. In the illustrated embodiment, soft target 50 comprises a multi-story building, at least a part of which is buried below ground level 55.

Subsequent to impacting the target 50, the warhead W releases the payload material by any of the previously described mechanisms (e.g.—unassisted through venturi openings in the warhead casing, by forced expulsion, etc.). The payload-air mixture preferably forms an explosive cloud 56. Through the appropriate selection of payload materials and expulsion techniques, a number of different effects can be achieved.

For instance, selection of a payload material that, upon vaporization, is lighter than air, will cause the explosive mixture to travel upwards, preferably through one or more of the openings created by the warhead W in the various floors 51, 52, 53 (etc.) of the soft target 50.

The mixture is then ignited by appropriate means, as previously disclosed. In the situation where the explosive cloud has traveled upward into different stories or areas of the target, it is likely that an obstructed path is present for a flame propagating through the explosive cloud 56. This obstructed path creates obstacles to the flame, causing turbulent flow at the leading end of the flame, which in turn accelerates the propagation of the leading end of the flame. This acceleration, which is proportional to the number and degree of obstruction, enhances the effectiveness of the weapon.

This feature provides an important advantage over conventional blast attacks using high explosives. In the typical scenario, shock waves created by the explosive are attenuated by such obstructions in their path, thereby reducing their effectiveness. By contrast, such obstructions increase the effectiveness of the present invention.

Alternatively, the payload material can be selected such that, upon vaporization, is heavier than air, thereby causing the explosive mixture to travel downward. In the scenario where the target 50 is a multi-story building, and the warhead W penetrates all the way to the lowest level 54 of the structure, the explosive cloud 56 can diffuse into utility connections such as sewer lines, power lines, water lines, (etc.). Thus, upon ignition of the cloud 56, these critical operative aspects of the target can be destroyed. Moreover, critical structural components of the target can be effectively damaged or destroyed.

Importantly, another advantage of the present invention when compared to conventional explosive attack it that the damage effected by a deflagration and/or detonation created within the target according to the principles of the present invention can be substantially confined to the target, thereby minimizing unwanted collateral damage. According to the present invention, it can be expected that exterior walls of the structure will be separated, however, with the corresponding internal pressure relief, the effects of the deflagration/detonation do not propagate significantly beyond the exterior walls. Thus, the collateral effects of an attack carried out according to the principles of the present invention are minimized.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for defeating a hard and deeply buried target, wherein the target comprises a plurality of air vents, comprising the steps of:

positioning a kinetic warhead in, or close proximity to, at least one of the plurality of air vents;

expelling a gaseous payload from the warhead using a flexible expandable bladder and a venturi jet into the at least one of the plurality of air vents, therein creating an ignitable mixture of expelled payload and air;

delaying ignition of the mixture for a predetermined amount of time;

and igniting the mixture.

2. Method according to claim 1, wherein the positioning step further comprises the step of soft landing the warhead.

3. Method according to claim 1, wherein the positioning step further comprises the step of hard landing the warhead.

4. Method according to claim 1, wherein the predetermined amount of time is at least one minute.

5. Method according to claim 1, wherein the predetermined amount of time is approximately the amount of time necessary for the mixture to penetrate into the working areas of the target.

6. Method according to claim 5, wherein the working areas of the target include a air handling unit for the target.

7. Method according to claim 1, wherein the payload is a liquid and the expelled payload is a vaporized liquid.

8. Method according to claim 7, wherein the payload is a hydrocarbon or a mixture of hydrocarbons.

9. Method according to claim 1, wherein the mixture is combustible or explosive.

10. Method according to claim 9, wherein the mixture has a density greater than the density of atmospheric air.

11. Method according to claim 1, wherein the expelled payload is able to pass through high efficiency particulate arrestance filters.

12. A warhead for defeating a hard or soft target, comprising:

a kinetic warhead casing;

a gaseous payload contained within the casing; and an expandable bladder located inside casing;

a gas generator, wherein the gas generator expands the expandable bladder to displace and expel the payload from the casing;

an igniter;

whereby the payload is expelled from the casing at a predetermined rate, creating a mixture of expelled payload and air, and the mixture is detonated by the igniter after a predetermined amount of time.

13. Warhead according to claim 12, wherein the predetermined rate is a slow and controlled rate.

14. Warhead according to claim 12, wherein the predetermined amount of time is greater than one minute.

15. Warhead according to claim 12, wherein the predetermined amount of time is approximately the amount of time necessary for the mixture to penetrate into the working areas of the target.

16. Warhead according to claim 12, wherein the expelled payload is able to pass through high efficiency particulate arrestance filters.

* * * * *

UNITED STATES PATENT AND TRADEMARK OFFICE

CERTIFICATE OF CORRECTION

PATENT NO. : 6,698,357 B2
DATED : March 2, 2004
INVENTOR(S) : John W. Jones

It is certified that error appears in the above-identified patent and that said Letters Patent is hereby corrected as shown below:

Column 10,
Line 26, “a air” and insert therefor -- an air --; and
Line 42, delete “inside casing” and insert therefor -- inside the casing --.

Signed and Sealed this

Twenty-first Day of June, 2005

JON W. DUDAS
*Director of the United States Patent and Trademark Office*